US005380110A

United States Patent [19]

Festa

[11] Patent Number: 5,380,110

[45] Date of Patent: Jan. 10, 1995

[54] PACKET CONTAINING TREATMENT LIQUID WITH APPLICATOR AND METHOD

[76] Inventor: Joseph F. Festa, 770 Northrup St., Suite 5, San Jose, Calif. 95126

[21] Appl. No.: 7,113

[22] Filed: Jan. 21, 1993

[51] Int. Cl.[6] ..... A47L 23/04; A45D 34/00

[52] U.S. Cl. ..... 401/132; 206/461; 206/466; 206/469; 206/484; 222/107; 222/541; 401/28; 401/37; 401/139

[58] Field of Search ..... 401/139, 132, 7, 8, 401/28, 37; 206/469, 461, 466, 484; 220/359; 222/107, 541

[56] References Cited

U.S. PATENT DOCUMENTS

| | | | |
|---|---|---|---|
| 2,044,428 | 6/1936 | Gilmer | 401/8 |
| 2,419,896 | 4/1947 | Hobelmann | 401/7 |
| 2,878,967 | 3/1959 | Duke | 222/107 |
| 3,053,385 | 9/1962 | Spees | 401/132 |
| 3,143,276 | 8/1964 | Nichols | 206/466 X |
| 3,214,783 | 11/1965 | Perry et al. | 401/28 |
| 3,369,267 | 2/1968 | Friedland et al. | 401/132 X |
| 3,369,709 | 2/1968 | Clauss | 222/107 |
| 3,630,346 | 12/1971 | Burnside | 206/461 X |
| 3,806,260 | 4/1974 | Miller | 401/132 X |
| 3,826,259 | 7/1974 | Bailey | 401/132 |
| 3,899,080 | 8/1975 | Brunda | 206/461 X |
| 4,127,339 | 11/1978 | Malacheski et al. | 401/132 |
| 4,596,481 | 6/1986 | Tanaka | 401/132 |
| 4,735,335 | 4/1988 | Torterotot | 220/359 X |
| 4,913,307 | 4/1990 | Takata et al. | 220/359 X |
| 4,963,045 | 10/1990 | Willcox | 401/132 |
| 5,125,529 | 6/1992 | Torterotot | 220/359 X |

FOREIGN PATENT DOCUMENTS

| | | | |
|---|---|---|---|
| 160450 | 4/1904 | Germany | 401/28 |
| 2155069 | 5/1973 | Germany | 206/461 |

*Primary Examiner*—Steven A. Bratlie

*Attorney, Agent, or Firm*—Flehr, Hohbach, Test, Albritton & Herbert

[57] ABSTRACT

A packet for use in treating a surface and having an applicator formed of a plastic sheet material. The applicator has at least one hole therein and has a first and second sides. A reservoir of a liquid is formed on the second side of the applicator. A plastic sheet overlies the first side of the applicator and the hole therein. A first inner heat seal circumscribes the hole and bonds the plastic sheet to the applicator. A removable plastic pull tab sheet is provided. A second inner heat seal secures the pull tab sheet to the plastic sheet and is disposed within the first heat seal and circumscribes the hole whereby when the pull tab sheet is lifted off of the plastic sheet an opening is provided which exposes the hole to permit liquid carried within the liquid reservoir to be expelled through the opening for application to the surface to be treated.

11 Claims, 1 Drawing Sheet

PACKET CONTAINING TREATMENT LIQUID WITH APPLICATOR AND METHOD

This invention relates to a packet containing a treatment liquid with an applicator contained therein and a method.

Packets have heretofore been provided which have contained moisturized cloths which have been utilized for various purposes, as for example cleansing purposes or for spot removal. Such packets have failed to fulfill various requirements and have been relatively ineffective for spot removal. There is therefore need for a new and improved packet which overcomes these objections.

In general, it is an object of the present invention is to provide a packet containing a treatment liquid with an applicator and method.

Another object of the invention is to provide a packet of the above character which can be utilized for various purposes.

Another object of the invention is to provide a packet of the above character which can be utilized as a spot remover.

Another object of the invention is to provide a packet of the above character which can be utilized as a shoe polish applicator.

Another object of the invention is to provide a packet of the above character for a shaving material.

Another object of the invention is to provide a packet of the above character which can be utilized as a shampoo pad.

Another object of the invention is to provide a packet of the above character which can be utilized as an air freshener.

Another object of the Invention is to provide a packet of the above character which can be readily opened.

Another object of the invention is to provide a packet of the above character which has a relatively long shelf life.

Another object of the Invention is to provide a packet of the above character in which the applicator can be utilized to serve as an agitator.

Another object of the invention is to provide a packet of the above character which is formed essentially of plastic and which can be heat sealed.

Another object of the Invention is to provide a packet of the above character in which it can be utilized without the liquid coming into contact with the user's hands.

Additional objects and features of the invention will appear from the following description in which the preferred embodiments are set forth in detail in conjunction with the accompanying drawings.

Figure 1:
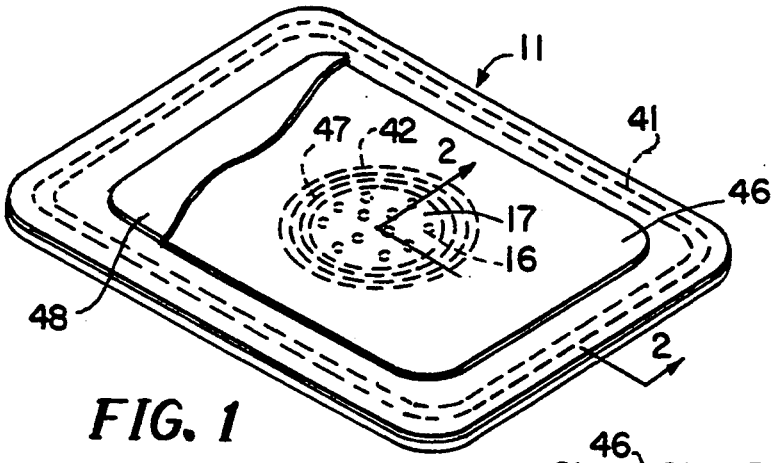
FIG. 1 is an isometric view of a packet containing a treatment liquid with an applicator incorporating the present invention.

In general, the packet of the present invention is comprised of an applicator formed of a plastic sheet material and having at least one hole and having first and second sides. The applicator has raised portions therein extending away from said first side. Means is provided which forms a reservoir of liquid on the second side of the applicator in communication with at least one hole in the applicator. Plastic sheet means is provided for forming a first seal with the first side of the applicator. Removable pull tab means forms a second seal with the plastic sheet means within the first seal whereby when the pull tab means is removed an opening is formed in the plastic sheet means exposing said at least one hole and said raised portions.

More particularly as shown in the drawings, the packet 11 incorporating the present invention consists of an applicator 12 in sheet form which can be semi-rigid and formed of a suitable plastic material such as a high-density polyethylene and having a thickness ranging from 8–20 millimeters. The applicator 12 can have suitable dimensions, as for example it can be rectangular having a length of approximately 3 $\frac{3}{8}$ inches and a width of 2 $\frac{1}{4}$ inches.

It should be appreciated that if desired other sizes either larger or smaller can be utilized for the applicator. The applicator is provided with first and second sides 13 and 14 which are generally planar and parallel with respect to each other. The applicator 12 is provided with a plurality of spaced-apart bumps or raised portions 16 of a suitable diameter such $\frac{1}{8}$ to $\frac{3}{8}$ths of an inch which extend through said first side and extend beyond the first side a suitable distance ranging from 1/16th to $\frac{1}{4}$th of an inch. The bumps or raised portions 16 are generally located in a predetermined area of the applicator 12, as for example as shown in FIG. 1 they can be disposed in a circular region or area 17 within the central portion of the applicator.

Figure 2:
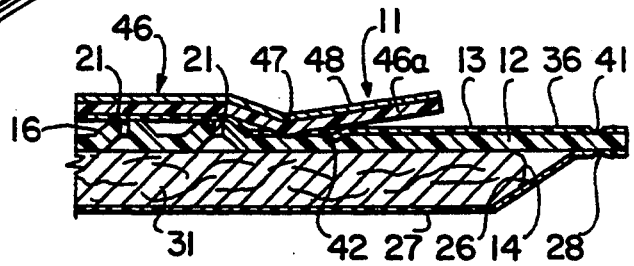
FIG. 2 is a cross-sectional view taken along the line 2—2, FIG. 1.
Figure 3:
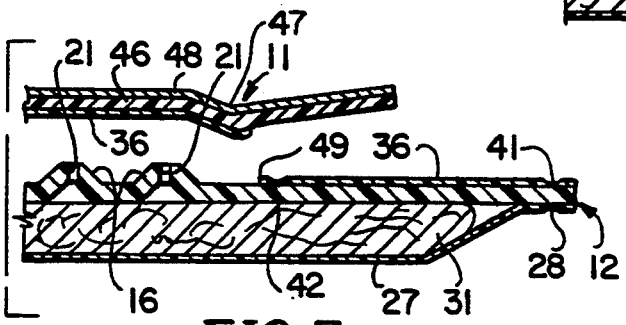
FIG. 3 is a cross-sectional view similar to FIG. 2 showing the lift-off tab removed.

At least one and preferably a plurality of spaced-apart holes 21 are provided in the applicator 12 and extend through the sides 13 and 14 of the same. As shown, the holes 21 can be formed in registration with the raised portions or bumps 16 so that they extend through the raised portions 16 as shown in FIGS. 2 and 3.

Means is provided for forming a liquid reservoir 26 on the second side of the applicator 12 in communication with the hole or holes 21. The liquid reservoir can contain any liquid for example, creams and liquids of various types. The means forming the liquid reservoir should be relatively impervious to liquid and/or air so that the packet can have a relatively long shelf life. Such means can take the form of a first relatively flexible plastic sheet 27 formed of a suitable plastic material such as high-density polyethylene having a suitable thickness, as for example 3–5 millimeters and preferably a thickness of 4 millimeters. The outer margin of the first plastic sheet is bonded to the first side of the plastic applicator 12 by suitable means such as a heat seal 28 extending around the outer perimeter of the applicator 12. To facilitate retention of the liquid within the liquid reservoir 26 and for gradually dispensing the liquid from the liquid reservoir 26, a liquid absorbent pad 31 can be provided within the reservoir 26 and can take the form of a pad formed of a polyester and having a suitable thickness ranging from 1/16 inches to $\frac{3}{8}$ inches and preferably about $\frac{1}{8}$ inches. The pad 31 as shown can have an outer dimension which is only slightly less than that of the applicator 12 so that it can be readily confined within the reservoir 26 formed by the first plastic sheet 27 while permitting the heat seal 28 to be formed around the outer perimeter. Before the heat seal operation, the pad 31 can be totally immersed in the desired liquid before encapsulating the same within the reservoir 26. If desired, additional liquid can be provided in the reservoir 26 to ensure that the pad will always have a maximum amount of liquid retained therein.

A second plastic sheet 36 is provided on the first side of the applicator 12 and can be formed of the same material and of the same thickness as the first flexible plastic sheet 27. The second plastic sheet 36 overlies the first surface. Means is provided for sealing the outer margin of the second plastic sheet 36 to the first side of the applicator 12 and can be in the form of a first heat seal 41. A first inner heat seal 42 is provided between the second plastic sheet 36 and the applicator 12 which as shown can be circular and surrounds the area 17 having the raised portions 16 and the holes 21 therein.

A pull tab sheet 46 is provided which overlies the area 17. The pull tab sheet 46 should be formed of a heavier sheet material than the second plastic sheet 36, as for example 8 millimeters high-density polyethylene and is heat sealed to an inner margin of the second plastic sheet 36 by a releasable second inner heat seal 47 within the heat seal 42 which also circumscribes the area 17 and forms a liquid-tight seal therebetween so that the hole or holes 21 provided in the applicator 12 are closed off from the outside world or ambient with respect to the reservoir 26. This heat seal 47 is formed so that a bond is only formed between the pull tab sheet 46 and the second plastic sheet 36 and not between the second plastic sheet 36 and the applicator 12. The pull tab sheet 46 is provided with the free outer margin 46*a* which is adapted to be grasped by the hand and which can be lifted to separate the second plastic sheet 36 along the heat seal 47 to expose the raised portions or bumps 16 and the holes 21 provided in the applicator 12.

It should be appreciated that if desired, the second plastic sheet 36 can be provided with a large hole (not shown) which overlies the area 17 to provide an opening to expose the bumps 16 and the holes 21. The two heat seals 42 and 47 would be formed in the same manner and would circumscribe such a hole. Also if desired, a label 48 formed of a suitable material such as plastic can be secured to the outer surface of the pull tab sheet 46 (see FIG. 1) and secured thereto by a suitable means such as an adhesive. Such a label can carry printing which may include a trademark and operating and use instructions for the packet. Alternatively, the label 48 can be eliminated and the printing can be applied directly to the outer surface of the pull tab sheet 46.

It can be readily seen that the packet construction hereinbefore described in FIGS. 1—3 lends itself to automatic production of the same. For example, the applicator 12, the first plastic sheet 27, the pad 31 and the second plastic sheet 36 and the pull tab 46 can be provided on separate rolls and fed continuously into conventional production equipment. Thus, bumps or raised portions can be provided on the applicator 12 with holes therein or with one or more holes disposed adjacent the same. The various components can be cut to appropriate lengths and then heat sealed in the manner hereinbefore described so that the pad which has been impregnated with the desired liquid is encapsulated between the first plastic sheet and the applicator. The second side is encapsulated within the second plastic sheet which may or may not have holes in registration with the pattern of bumps provided on the applicator. The sheet-like pull tab 46 can be severed and applied over the second flexible sheet and then heat bonded in the manner hereinbefore described to provide first, second and third seals on the first side of the applicator, with the third seal being disposed within the second seal. From the foregoing it can be seen that the packet 11 can be utilized for dispensing various types of liquids including creams, gels and the like. These liquids, creams or gels typically are provided in the pad which is disposed within the reservoir. Thus, by way of example spot removers, liquids, shaving gels, shampoo, ointments, medicaments, diaper rash ointments, and the like can be packaged in this manner.

For example, as shown in FIG. 3, the pull tab 46 can be lifted up by the fingers of the hand to cause the inner portion of the second plastic sheet to be separated at the heat seal 42 to provide a large hole 49 circumscribing and opening up the area 17. The packet can then be turned upside down. The spot remover can be pressed from the pad 31 by a finger or fingers of the hand to cause the liquid to exit through the hole 21 and onto the material from which the spot is to be removed. At the same time, the packet can be moved in a circular fashion to cause the raised portions or bumps 16 to agitate the fibers of the material being cleaned so that the spot remover can penetrate and remove all of the stain. This can be accomplished without any of the spot remover coming in contact with the hand of the user because the first and second plastic sheets 27 and 36 serve as a protector. After the spot remover has performed its function, the packet 11 can be disposed of because it is only intended for one-time use.

Figure 4:
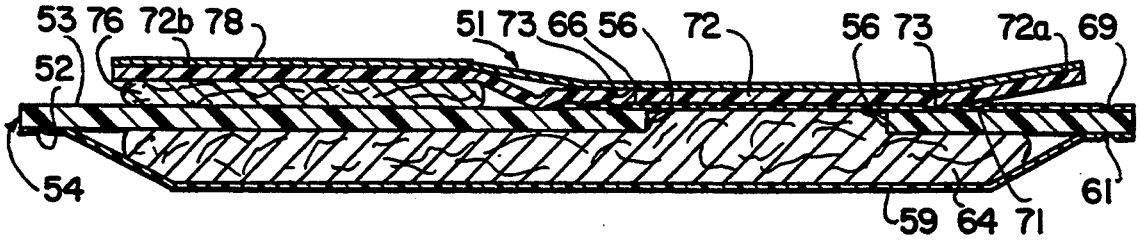
FIG. 4 is a cross-sectional view of a packet incorporating the present invention which is for use as a shoe polish applicator.
Figure 5:
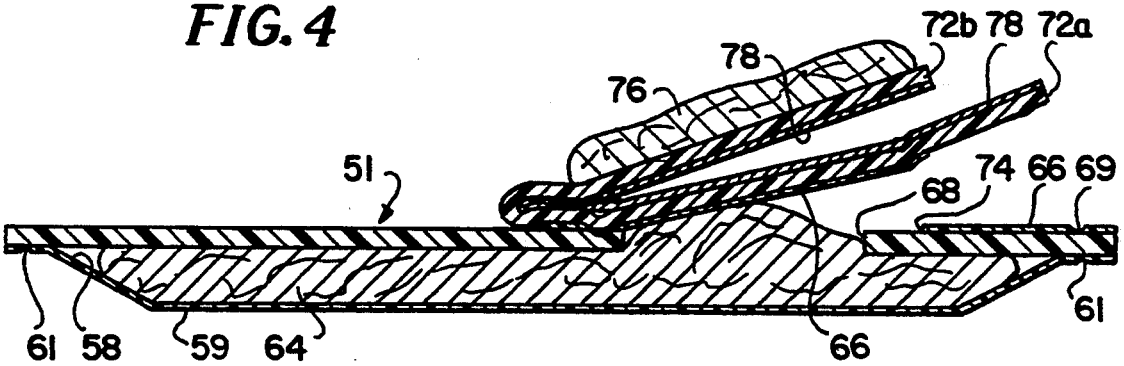
FIG. 5 is a cross-sectional view similar to FIG. 4 showing the packet as it is to be used.

In certain applications of the packet, it may be desirable to provide an applicator which does not have the raised portions or bumps 16, as for example with a diaper rash ointment. Also, as shown in FIGS. 4 and 5 there is shown an embodiment of the invention in which the applicator does not have raised portions or bumps. The packet 51 shown in FIG. 4 which can be utilized as a shoe polish applicator consists of an applicator 52 similar to applicator 12 which is provided with first and second sides 53 and 54. The applicator 52 is provided with a relatively large hole 56 extending through the first and second sides. A reservoir 58 is provided on the second side of the applicator 52 by a first plastic sheet 59 which has its outer perimeter heat sealed by a heat seal 61 to the outer margin of the applicator 52 and pad 64 is provided within the reservoir 58 and is formed of a desirable material for retaining a shoe polish, as for example a pad 64 formed of a polyester. The pad 64 can be impregnated with a liquid or a paste-like shoe polish of the appropriate color.

A second plastic sheet 66 overlies a portion of the first side 53 of the applicator 52 and the hole 56 provided in the applicator 52. An outer heat seal 69 bonds the outer perimeter of the second plastic sheet 66 to the applicator 52. Means is provided for establishing a first inner heat seal 71 which bonds the second plastic sheet 66 to the first side 53 of the applicator 52. A plastic pull tab sheet 72 overlies the second plastic sheet 66 and most of the remainder of the first side 53 of the applicator 52. A second inner heat seal 73 secures the pull tab sheet 72 to the second plastic sheet 66. This second inner heat seal 73 is spaced inwardly from the first heat seal 71 and is enclosed by the same. The second inner heat seal forms such a seal between the second plastic sheet 66 and the pull tab sheet 72 but not between the second plastic sheet 66 and the applicator 52.

The pull tab sheet 72 is provided with a pull tab portion 72*a* as shown in FIG. 4 which can be utilized for lifting the pull tab sheet 72 to cause separation the second plastic sheet 66 to occur at the heat seal of 73 to provide a large opening 74 circumscribing the hole 56 exposing the polyester pad 64 so that the polyester pad 64 containing the shoe polish can be pressed against the shoe to be polished. The shoe polish can then be applied to the shoe by appropriate motion of the packet 51. As soon as the polish has been applied, the applied polish can be polished by the use of a small pad 76 provided on the underside of the portion 72*b* of the pull tab sheet 72 and adhered thereto in a suitable manner such as by an adhesive (not shown). As shown in FIG. 5 after the polish has been applied, the pad for the portions 72*a* can be returned generally to its original position so that the pull tab sheet 72 overlies the opening 68 and then the portion 72*b* can be folded over on top of the portion 72*a* to permit the use of the pad 76 as a shoe polishing pad after the shoe polish has been applied. After the appropriate polishing has been completed, portions 72*a* and 72*b* can be returned to the other side of the packet and additional polish placed on the shoe or shoes if desired after which another polishing operation can be accomplished by merely flipping the portion 72*a* and 72*b* so they overlie the opening 68.

A label 78 of the type hereinbefore described can be applied to the exterior surface of a pull tab sheet 72 which can be utilized for carrying the trademark and other appropriate descriptive material for the packet as hereinbefore explained, the explained. Alternatively, the label 78 can be eliminated and the information carried thereby can be applied to the outer surface of the sheet 72.

The thicknesses and sizes of the material and the type of materials utilized in the plastic layers of the embodiment shown in FIG. 4 can be of the type hereinbefore described in conjunction with the packet 11 shown in FIG. 1.

From the two different types of construction shown in FIGS. 1 and 4 it can be seen that there are many uses for the packet. By increasing the area 17 in FIG. 1 so that it encompasses substantially all of the applicator 12, it is possible to provide a packet in which it can contain body oil or a lotion and which can be utilized for a massage. Similarly, such construction would be particularly suitable for use as a shampoo applicator or shaving cream or gel applicator.

From the foregoing it can be seen that a packet has been provided which contains a treatment liquid which contains an applicator which can be utilized in applying various types of liquids, creams, gels and lotions as well as shoe polish and other liquid or semi-liquid materials. The packets are of such a size that they can be readily carried in a wallet or in a purse so that they are ready for use whenever needed. They are formed of materials which will not accidentally rupture and cause undesired spilling of the contents. They can be manufactured in a relatively inexpensive manner so that they are suitable for one-time use applications. In using the same, the fingers of the user need not come in contact with the liquid contained within the packet.

What is claimed is:

1. In a packet for use with a human hand in treating a surface, the packet being generally planar in conformation, an applicator formed of a plastic sheet material and having at least one hole therein and having first and second sides, means forming a reservoir of a liquid on the second side of the applicator, plastic sheet means overlying the first side of the applicator and the hole therein, a first inner heat seal circumscribing said hole and bonding said plastic sheet means to said applicator, a removable plastic pull tab sheet, and a second inner heat seal securing said pull tab sheet to said plastic sheet means and forming a liquid-tight seal, said second inner heat seal being disposed within said first inner heat seal and circumscribing said at least one hole, an opening being provided in said plastic sheet means along said second inner heat seal when said pull tab sheet is lifted off of said plastic sheet means to expose said hole, whereby the packet can be grasped by the hand and the liquid carried within the liquid reservoir expelled by the finger of said hand through the opening for application to the surface to be treated.

2. A packet as in claim 1 wherein said pull tab sheet includes a pull tab which is adapted to be grasped by the hand to facilitate separating the pull tab sheet from the plastic sheet means so as to permit liquid carried within the liquid reservoir to be expelled through the opening in the plastic sheet means for application to the surface to be treated.

3. A packet as in claim 1 wherein said applicator is provided with a plurality of raised portions disposed in a predetermined area on the applicator and facing in a direction away from the first side.

4. A packet as in claim 3 wherein the applicator is provided with a plurality of holes and wherein the holes extend through the raised portions.

5. A packet as in claim 1 wherein said means forming a reservoir of a liquid on the second side of the applicator includes an absorbent pad for holding the liquid, additional plastic sheet means having an outer margin and a heat seal bonding the outer margin to the applicator.

6. In a packet for use with a human hand in treating a surface, the packet being generally planar in conformation, first and second flexible plastic sheets impervious to a liquid, said first and second flexible plastic sheets having outer margins, an applicator member formed of a semi-rigid plastic material disposed between said first and second flexible plastic sheets and having at least one hole extending therethrough, said applicator member having a thickness greater than that of the first and second flexible plastic sheets and having an outer margin, means forming a first seal between the outer margin of the first flexible plastic sheet and the outer margin of the applicator member to provide a liquid reservoir between the first flexible plastic sheet and the applicator member, means forming a first inner heat seal between the second flexible plastic sheet and the applicator member surrounding said at least one hole, a pull tab sheet formed of a flexible plastic sheet material overlying the second sheet, means forming a second inner heat seal between said second flexible plastic sheet and said pull tab sheet which is liquid-tight and surrounds said hole and which is disposed within the confines of the first inner heat seal, said pull tab sheet having a free outer margin serving as a tab adapted to be grasped by the fingers of the human hand, an opening being provided in the second plastic sheet along said second inner heat seal when the pull tab is pulled and separated from the second flexible sheet to expose said hole in the applicator member, whereby the liquid in the reservoir can be expelled by the fingers of the same hand from the reservoir through the hole in the applicator member and through the opening in the second flexible plastic sheet for application to the surface and the semi-rigid plastic material of the applicator member facilitates treatment of the surface with the liquid.

7. A packet as in claim 6 wherein said applicator is formed with spaced-apart raised portions projecting towards the second sheet.

8. A packet as in claim 7 wherein said applicator has a plurality of holes therein.

9. A packet as in claim 8 wherein said plurality of holes extend through the raised portions.

10. A packet as in claim 6 wherein said pull tab sheet includes a portion remote from the pull tab and said hole and a polishing pad adherent to the underside of said portion.

11. A packet as in claim 1 wherein said plastic sheet means and said pull tab sheet are of relative types in which the plastic sheet means is more likely to tear than the pull tab sheet when the pull tab sheet is lifted off the plastic sheet means.

* * * * *